US011666805B2

(12) United States Patent
Matsunaga

(10) Patent No.: US 11,666,805 B2
(45) Date of Patent: Jun. 6, 2023

(54) GOLF CLUB HEAD

(71) Applicant: Sumitomo Rubber Industries, Ltd., Hyogo (JP)

(72) Inventor: Kiyofumi Matsunaga, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/584,276

(22) Filed: Jan. 25, 2022

(65) Prior Publication Data

US 2022/0249922 A1 Aug. 11, 2022

(30) Foreign Application Priority Data

Feb. 5, 2021 (JP) ..... JP2021-017793

(51) Int. Cl.
*A63B 53/04* (2015.01)

(52) U.S. Cl.
CPC ..... *A63B 53/0458* (2020.08); *A63B 53/042* (2020.08); *A63B 53/047* (2013.01); *A63B 53/0408* (2020.08)

(58) Field of Classification Search
CPC . A63B 53/04; A63B 53/0416; A63B 53/0458; A63B 53/047
USPC ..... 473/324–350
See application file for complete search history.

(56) References Cited

U.S. PATENT DOCUMENTS 4,420,156 A * 12/1983 Campau ..... A63B 60/00 473/291
4,715,601 A * 12/1987 Lamanna ..... A63B 60/00 473/409
5,048,835 A * 9/1991 Gorman ..... A63B 53/047 473/350
5,766,094 A * 6/1998 Mahaffey ..... A63B 60/00 473/347
5,921,869 A * 7/1999 Blough ..... A63B 60/00 473/291
5,971,868 A * 10/1999 Kosmatka ..... A63B 69/3635 473/324
6,379,262 B1 * 4/2002 Boone ..... A63B 53/04 473/324
7,235,023 B2 * 6/2007 Sugimoto ..... A63B 53/047 473/291
7,749,102 B2 * 7/2010 Nakamura ..... A63B 53/047 473/349

(Continued)

FOREIGN PATENT DOCUMENTS

CA 2218837 A1 * 4/1998
CN 101014390 A * 8/2007 ..... A63B 53/02

(Continued)

*Primary Examiner* — Alvin A Hunter
(74) *Attorney, Agent, or Firm* — Studebaker & Brackett PC

(57) ABSTRACT

A golf club head includes a face portion including a hitting face for striking a ball, a sweet spot on the hitting face, a toe, a back face opposite the hitting face, and a first thin-walled region formed by being recessed the back face. In a front view of the face portion viewed from a direction orthogonal to the hitting face, the first thin-walled region is provided in a toe-upper region that is a region above and on a toe side with respect to the sweet spot, the first thin-walled region is provided outside a region having a radius of 5 mm centered on the sweet spot, and an area of the first thin-walled region is in a range from 15% to 70% of an area of the toe-upper region.

20 Claims, 13 Drawing Sheets

(56) References Cited

U.S. PATENT DOCUMENTS 8,535,177 B1 * 9/2013 Wahl ..... A63B 53/04 D21/748
8,753,230 B2 * 6/2014 Stokke ..... A63B 53/047 D21/749
10,335,653 B1 * 7/2019 Daraskavich ..... B23K 11/315
10,758,791 B2 * 9/2020 Norimura ..... A63B 53/047
2002/0065140 A1 * 5/2002 Iwata ..... A63B 53/04 473/291
2005/0003900 A1 * 1/2005 Sugimoto ..... A63B 53/047 473/290
2006/0199661 A1 * 9/2006 Deng ..... A63B 60/02 473/340
2008/0096689 A1 * 4/2008 Oyama ..... A63B 53/0466 473/349
2008/0102982 A1 * 5/2008 Wahl ..... A63B 53/047 473/335
2008/0113825 A1 * 5/2008 Funayama ..... A63B 53/0466 473/345
2008/0139334 A1 * 6/2008 Willett ..... A63B 53/0466 473/329
2008/0287216 A1 * 11/2008 Nakamura ..... A63B 53/047 473/350
2008/0300065 A1 * 12/2008 Schweigert ..... A63B 60/02 29/527.5
2009/0149277 A1 * 6/2009 Deng ..... A63B 60/00 219/121.64
2010/0160067 A1 * 6/2010 Llewellyn ..... A63B 53/047 473/291
2010/0178997 A1 * 7/2010 Gibbs ..... A63B 53/0466 473/345
2012/0021849 A1 * 1/2012 Gibbs ..... A63B 53/0466 473/342
2012/0252600 A1 * 10/2012 Tsuji ..... A63B 53/047 473/332
2012/0289360 A1 * 11/2012 Breier ..... A63B 53/047 473/335
2014/0080633 A1 * 3/2014 Bezilla ..... A63B 53/04 473/342
2015/0051013 A1 * 2/2015 Ueda ..... A63B 60/54 473/342
2018/0085643 A1 * 3/2018 Wahl ..... A63B 53/0475
2022/0249922 A1 * 8/2022 Matsunaga ..... A63B 60/52

FOREIGN PATENT DOCUMENTS

CN 101385896 A * 3/2009 ..... A63B 53/047
GB 2331249 A * 5/1999 ..... A63B 53/04
JP 2003245384 A * 9/2003 ..... A63B 53/0466
JP 2004187710 A * 7/2004 ..... A63B 53/047
JP 2008515560 A * 5/2008
JP 2008-284155 A 11/2008
JP 2010088630 A * 4/2010 ..... A63B 53/0466
JP 4546681 B2 * 9/2010
JP 2022120711 A * 8/2022 ..... A63B 53/0408
WO WO-2017019807 A1 * 2/2017 ..... A63B 53/04

* cited by examiner s1 cross-setion

GOLF CLUB HEAD

RELATED APPLICATIONS

This application claims the benefit of foreign priority to Japanese Patent Application No. JP2021-017793, filed Feb. 5, 2021, which is incorporated by reference in its entirely.

FIELD OF THE INVENTION

The present disclosure relates to a golf club head.

BACKGROUND OF THE INVENTION

Patent Document 1 below discloses an iron-type golf club head that can provide a good shot feeling.

Patent Document

[Patent document 11] Japanese Unexamined Patent Application Publication 2008-284155

SUMMARY OF THE INVENTION

Golf club heads such as irons, fairway woods or hybrids often hit golf balls placed directly on the grass. For this reason, this type of golf club head tends to hit balls frequently at a position of about 15 mm upward from the lowermost end of the hitting face.

On the other hand, the position where the rebound is highest in the hitting face is near the sweet spot. Unfortunately, in the case of a golf club head as described above, the sweet spot is usually located about 20 to 22 mm upward from the lowermost end of the hitting face. Thus, in this type of golf club head, the major hitting position and the high rebound position may not match, and there has been room for further improvement in improving the flight distance of hit balls.

The present disclosure has been made in view of the above circumstances and has a major object to provide a golf club head having a lower sweet spot capable of improving the rebound performance at the major striking position without compromising durability.

In one aspect of the present disclosure, a golf club head includes a face portion including a hitting face for striking a ball, a sweet spot on the hitting face, a toe, a back face opposite the hitting face, and a first thin-walled region formed by being recessed the back face. In a front view of the face portion viewed from a direction orthogonal to the hitting face, the first thin-walled region is provided in a toe-upper region that is a region above and on a toe side with respect to the sweet spot, the first thin-walled region is provided outside a region having a radius of 5 mm centered on the sweet spot, and an area of the first thin-walled region is in a range from 15% to 70% of an area of the toe-upper region.

DETAILED DESCRIPTION OF THE INVENTION

Figure 1:
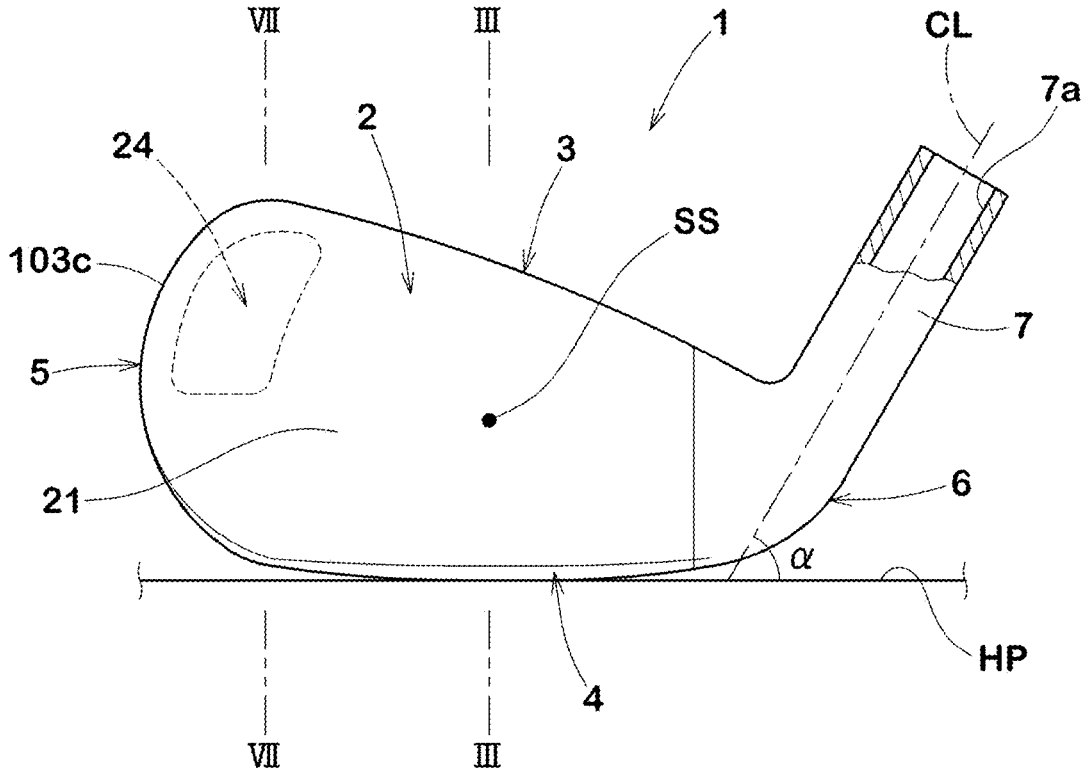
FIG. 1 is a front view of a golf club head in accordance with the present embodiment.
Figure 2:
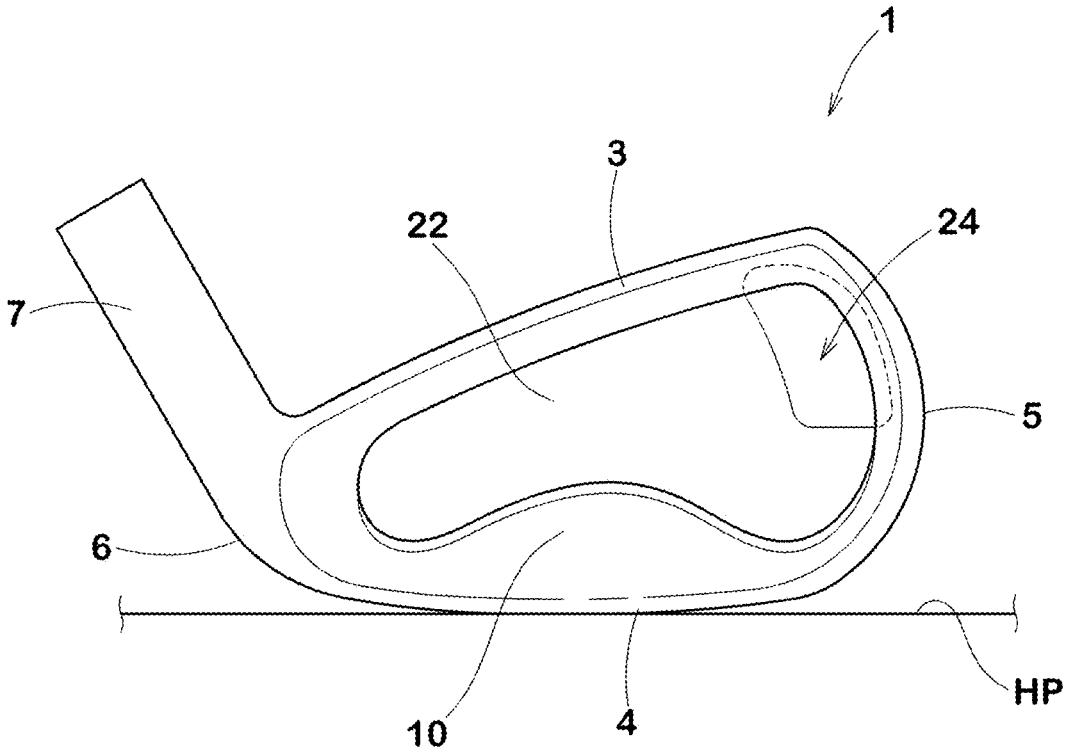
FIG. 2 is a rear view of the golf club head in accordance with the present embodiment.

Hereinafter, one or more embodiments of the present disclosure will be described with reference to the drawings. The embodiments disclosed below are not intended to be limited in any way. Further, the disclosed embodiments can be used alone or in various combinations. Furthermore, throughout the specification, the same or common elements are given the same reference numerals, and duplicate explanations are omitted.

FIGS. 1 to 4 are respectively a front view, a rear view, a cross-sectional view taken along the line III-III of FIG. 1, and an exploded perspective view of a golf club head (hereinafter, simply referred to as "head") 1 in accordance with the present embodiment. The present disclosure may be suitably embodied as a head that often hits a golf ball placed directly on the grass. In the present embodiment, an iron type golf club head is exemplified as such a head. In another embodiment, the head 1 may be configured, for example, as a fairway wood or a utility.

The head 1, for example, includes a face portion 2, a top 3, a sole 4, a toe 5, a heel 6 and a hosel 7.

The face portion 2 includes a hitting face 21 for striking a ball, and a back face 22 opposite the hitting face 21. A plurality of face lines 8 (shown in FIG. 5) may be formed on the hitting face 21 for the purpose of increasing friction with the ball. The face lines 8 are grooves extending in the toe-heel direction. The face lines 8 are omitted in the drawings other than FIG. 5.

[Reference State]

In FIGS. 1 to 4, the head 1 is in a reference state. As used herein, the "reference state" of the head 1, as conceptually shown in FIG. 5, is a state that the head 1 is placed on a horizontal plane HP with the face lines 8 formed on the hitting face 21 of the head 1 parallel to the horizontal plane HP. In the reference state, the shaft center axis CL (axis of the club shaft) of the hosel 7 of the head 1 is placed in a reference vertical plane VP. The reference vertical plane VP is a plane perpendicular to the horizontal plane HP. In the reference state, the face lines 8 are parallel to both the horizontal plane HP and the reference vertical plane VP. In FIG. 5, "α" indicates the lie angle and "β" indicates the loft angle of the head 1. In the present specification and claims, unless otherwise specified, the head 1 is described as being placed in the reference state, and the structure of each portion is described.

[Directions of Head]

Referring to FIG. 5, "front side" of the head 1 means a hitting face 21 side in the reference state. The "back" or "rear" side of the head 1 means the opposite side of the hitting face 21. The "head front-back direction" means the direction of the x-axis orthogonal to the reference vertical plane VP in FIG. 5. The "toe-heel direction" of the head 1 means the horizontal y-axis direction orthogonal to the front-back direction of the head. The "vertical direction" of the head 1 means the direction of the z-axis orthogonal to both the x-axis and the y-axis. The "upper side" and "lower side" of the head 1 correspond to the "upper side" and "lower side" in the reference state, respectively.

[Structure of Head]

Figure 3:
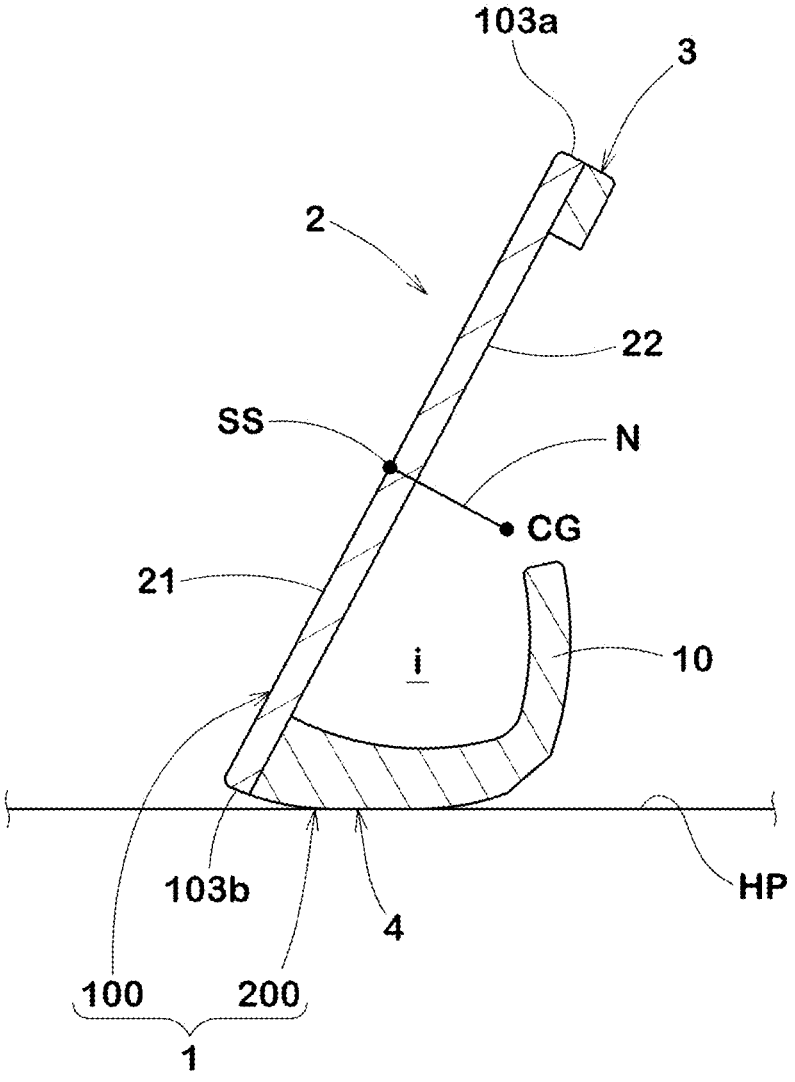
FIG. 3 is a cross-sectional view taken along the lines III-III of FIG. 1.

As illustrated in FIG. 1 and FIG. 3, the hitting face 21 includes a sweet spot SS. As illustrated in FIG. 3, the sweet spot SS is the intersection of the normal N drawn to the hitting face 21 from the center of gravity CG of the head and the hitting face 21. The sweet spot SS is one of the striking points with excellent resilience.

In the iron-type head 1 according to the present embodiment, the hitting face 21 is formed by a plane. Thus, in the iron-type head, the face portion 2 is a portion having such a hitting face 21 on the front.

Figure 6A:
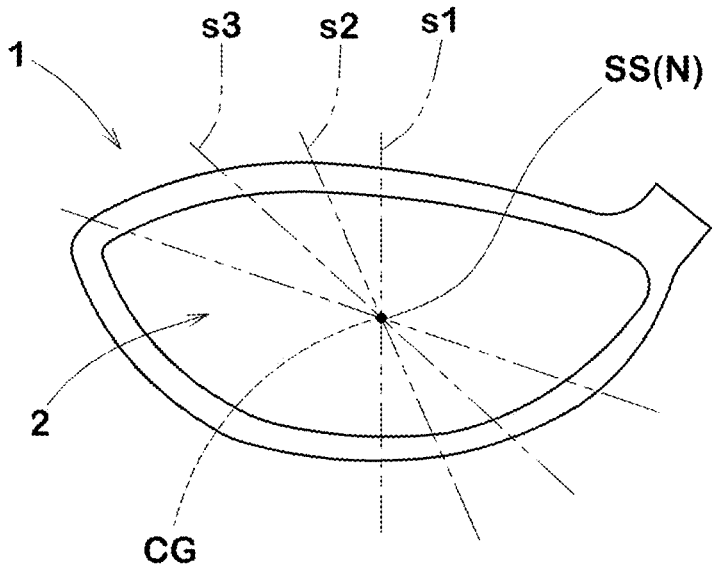
FIG. 6A is a front view of the golf club head.
Figure 6B:
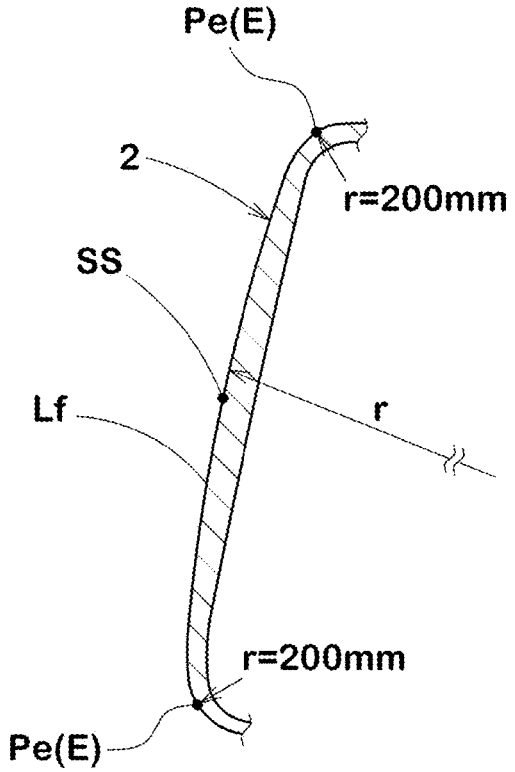
FIG. 6B is a cross-sectional view taken along the line s1 of FIG. 6A.

On the other hand, when the head 1 is a fairway wood or hybrid, the hitting face 21, for example, can be formed by a curved surface with a face roll and/or bulge. In this case, the face portion 2 is a portion surrounded by a periphery edge of the hitting face 21. As used herein, the peripheral edge E of the hitting face 21 is defined as follows. First, as illustrated in FIG. 6A, cross sections including the normal N passing the center of gravity CG of the head and the sweet spot SS are specified. Next, as illustrated in FIG. 6B, in each of the cross sections s1, s2, s3 . . . , the positions Pe where the radius of curvature r of the contour line Lf of the hitting face 21 becomes 200 mm for the first time from the sweet spot SS side toward outwardly of the club face are specified, and a series of these positions Pe in the cross sections is defined as the peripheral edge E of the hitting face 21.

As illustrated in FIG. 3, the top 3, for example, extends backwardly of the head 1 from an upper peripheral edge of the hitting face 21 to form an upper surface of the head 1. The top 3 may be referred to as "crown" or "head upper portion".

The sole 4 extends backwardly of the head 1 from a lower peripheral edge of the hitting face 21 to form a bottom surface of the head 1. The sole 4 may be referred to as "bottom of head". In the present embodiment, a back wall 10 is provided behind the sole 4. The back wall 10 extends upwardly of the head from a portion away from the back face 22. Thus, the head 1 according to the present embodiment has a pocket-shaped cavity i behind the face portion 2. The back wall 10 helps to offer the center of gravity CG of the head lower and deeper.

The toe 5 is the farthest end from the hosel 7 in the toe-heel direction of the head 1 and which connects the top 3 with the sole 4 smoothly. The heel 6 is the end of the head 1 opposite the toe 5 in the toe-heel direction, to which the hosel 7 is connected.

As shown in FIG. 1, the hosel 7, for example, has a cylindrical shape with a shaft insertion hole 7*a* for receiving a club shaft (not illustrated). The central axis of the shaft insertion hole 7*a* defines the central axis CL of the hosel 7.

Figure 4:
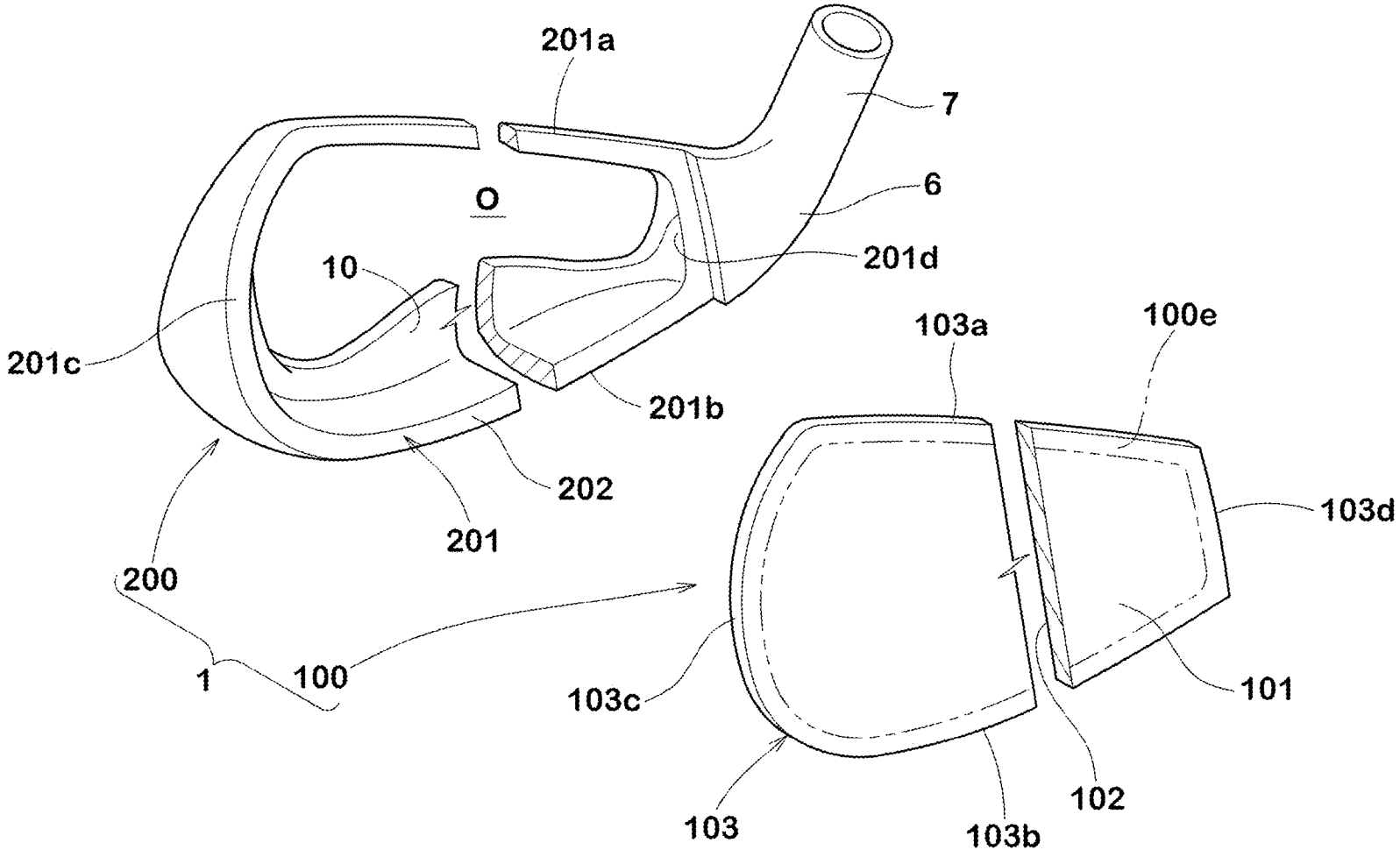
FIG. 4 is an exploded perspective view of the golf club head in accordance with the present embodiment.
Figure 5:
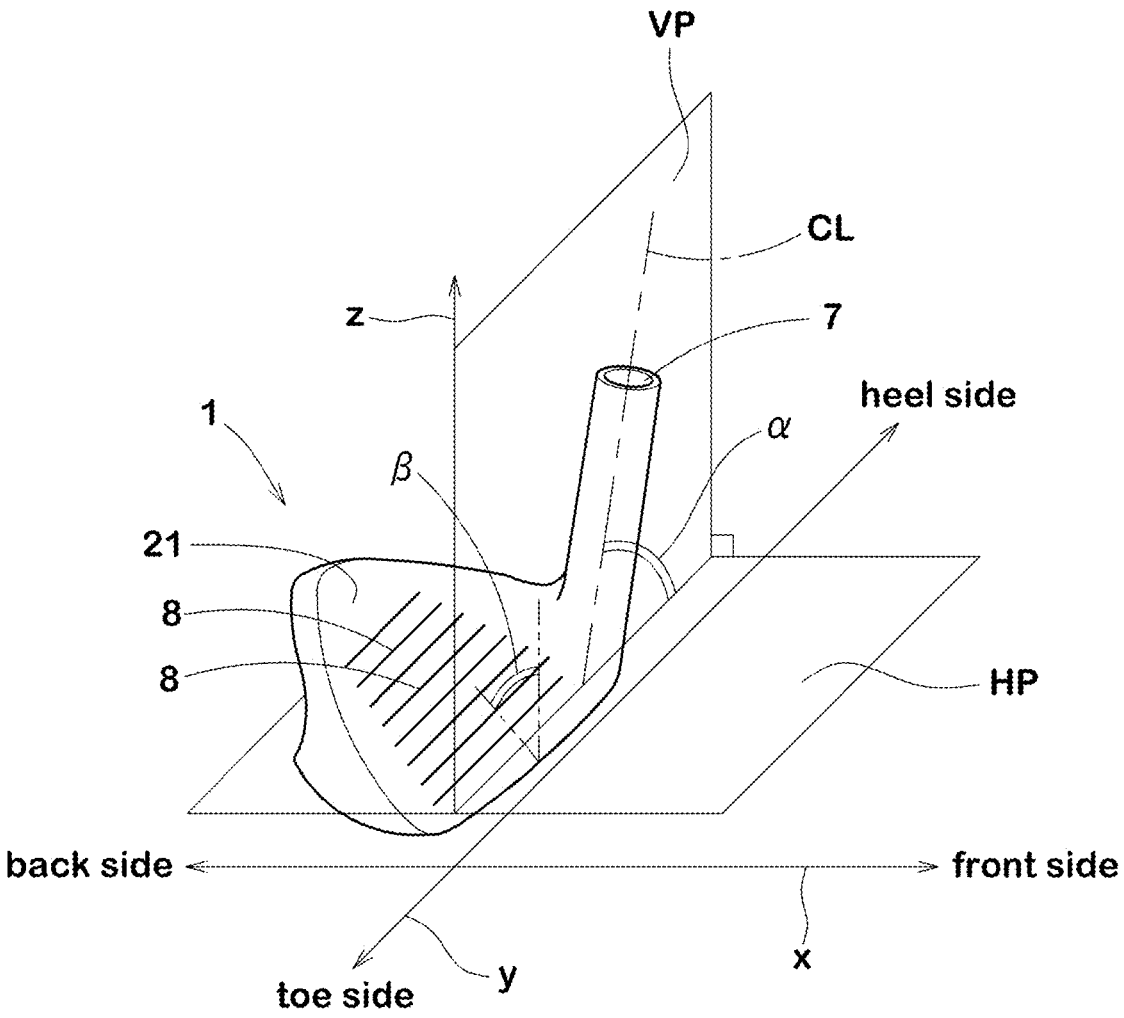
FIG. 5 is a schematic perspective view of the golf club head to explain a reference state.

As illustrated in FIG. 4, the head 1 according to the present embodiment, for example, includes a face plate 100 and the head main body 200 that is fixed to the face plate 100.

In the present embodiment, the face plate 100 and the head main body 200 are made of different metal materials. For the face plate 100, a metal material having high strength is suitable, and for example, titanium, titanium alloy, stainless steel, maraging steel, etc. may be adopted. For the head main body 200, stainless steel, carbon steel for machine structure, etc. may be suitable, for example.

The face plate 100 according to the present embodiment has a plate shape which includes a front surface 101, a back surface 102, and a peripheral surface 103.

In the present embodiment, the front surface 101 of the face plate 100 constitutes a major portion of the hitting face 21.

In the present embodiment, the back surface 102 of the face plate 100 constitutes a major portion of the back face 22.

In the present embodiment, the peripheral surface 103 of the face plate 100, for example, includes a top-side peripheral surface 103*a*, a sole-side peripheral surface 103*b*, a toe-side peripheral surface 103*c* and a heel-side peripheral surface 103*d*.

In some preferred embodiments, at least one of, preferably a plurality of, more preferably all of, the top-side peripheral surface 103*a*, the sole-side peripheral surface 103*b* and the toe-side peripheral surface 103*c* in the peripheral surface 103 of the face plate 100 are formed so as to be exposed at an outer surface of the head. In the present embodiment, as illustrated in FIG. 1 and FIG. 3, the top-side peripheral surface 103*a*, the sole-side peripheral surface 103*b* and the toe-side peripheral surface 103*c* of the face plate 100 are exposed at an outer surface of the head so as to form respective front portions of the top 3, the sole 4 and the toe 5. Such a face plate 100 can forms a wider range of the hitting face 21 and help to provide high rebound performance.

As illustrated in FIG. 4, the head main body 200, for example, includes the heel 6, the hosel 7, the back wall 10 and a face receiving portion 201.

The face receiving portion 201, for example, is formed in an annular shape so as to define an opening O penetrating in the head front-back direction, and which includes a top-side receiving portion 201*a*, a sole-side receiving portion 201*b*, a toe-side receiving portion 201*c*, and a heel-side receiving portion 201*d*. The top-side receiving portion 201*a*, the sole-side receiving portion 201*b* and the toe-side receiving portion 201*c* form rear portions of the top 3, the sole 4 and the toe 5, respectively, of the head 1. These receiving portions can distribute a large weight to a periphery region of the face portion 2 and help to increase the moment of inertia of the head 1.

The face receiving portion 201 also includes a support surface 202 that supports a peripheral portion 100*e* of the face plate 100 from a back side of the head 1. The support surface 202 according to the present embodiment includes front surfaces of the top-side receiving portion 201*a*, the sole-side receiving portion 201*b*, the toe-side receiving portion 201*c* and the heel-side receiving portion 201*d* which are continuous in an annular shape, for example. The face plate 100 and the head main body 200 are fixed by various joining methods such as welding, brazing, caulking, etc. so that the support surface 202 and the back face 22 are in contact with each other.

As described above, the face portion 2 of the head 1 according to the present embodiment is configured as a complex body of the face plate 100 and the face receiving portion 201. However, the head 1 according to the present disclosure is not limited to such an embodiment. In another aspect, the head 1 according to the present disclosure may have a one-piece structure integrally formed by casting, forging, and the like.

Figure 7:
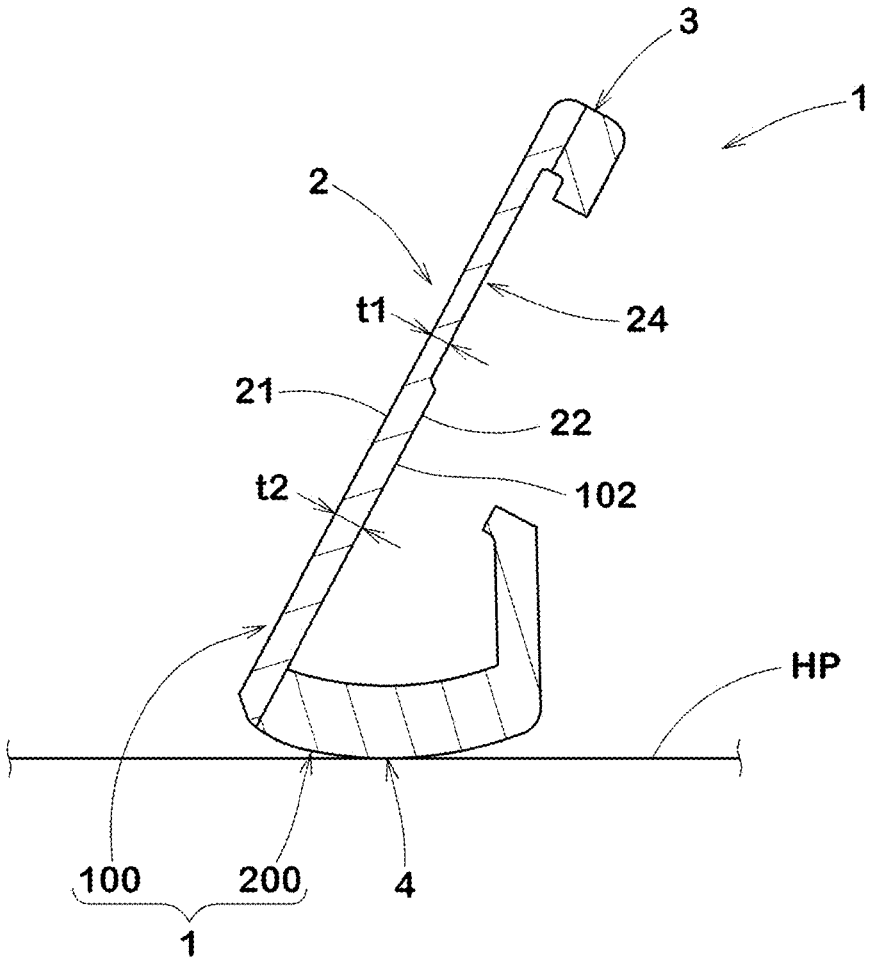
FIG. 7 is a cross-sectional view taken along the line VII-VII of FIG. 1.

FIG. 7 illustrates a cross-sectional view taken along the line VII-VII of FIG. 1. As illustrated in FIG. 1 and FIG. 7, a first thin-walled region 24 is provided in the face portion 2 by being recessed the back face 22. In the present embodiment, the first thin-walled region 24 is provided by being recessed the back surface 102 of the face plate 100.

The first thin-walled region 24, for example, includes a portion having a thickness t1. The thickness t1 is relatively small in the face portion 2. The thickness t1 of the first thin-walled region 24 according to the present embodiment is formed to be the smallest in the thickness distribution of the face portion 2 (e.g., the face plate 100).

First Embodiment

Figure 8:
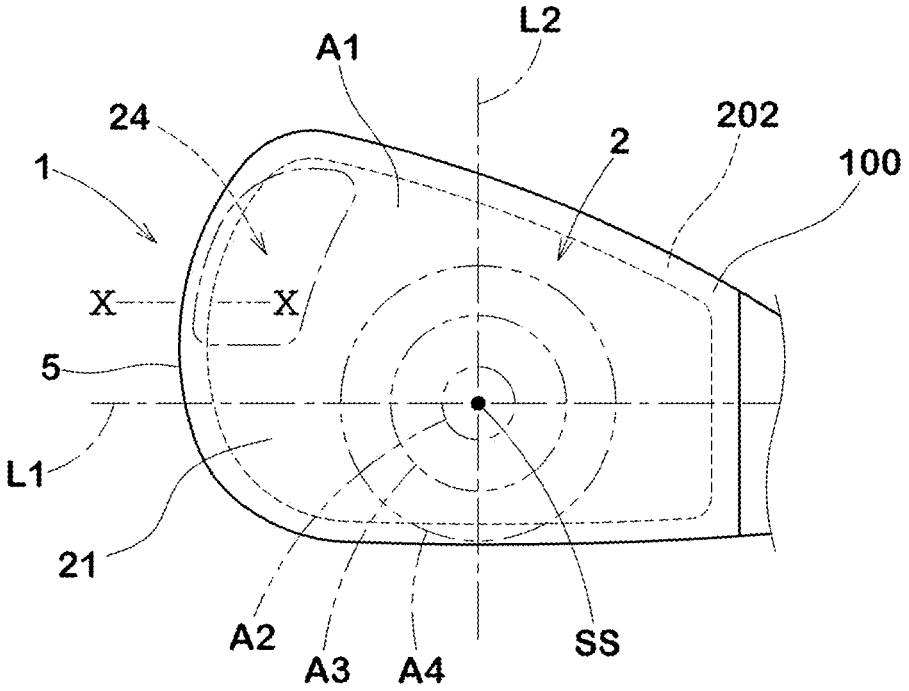
FIG. 8 is a front view of a hitting face in accordance with the first embodiment.

FIG. 8 illustrates a front view of the hitting face 21 viewed from a direction orthogonal to the hitting face 21. As illustrated in FIG. 8, the first thin-walled region 24 according to the first embodiment is provided in a toe-upper region A1 that is a region above and on the toe 5 side with respect to the sweet spot SS. The toe-upper region A1, in the front view of the hitting face 21, is located above a horizontal line L1 passing through the sweet spot SS and on the toe 5 side of a vertical line L2 passing through the sweet spot SS and orthogonal to the horizon L1.

In the present embodiment, the first thin-walled region 24 is a region with a closed contour. This contour is provided so as not to protrude from the toe upper region A1. In another embodiment, the first thin-walled region 24 may extend beyond the toe-upper region A1.

Further, in the front view of the hitting face 21, the first thin-walled region 24 is provided outside a region A2 with a radius of 5 mm centered on the sweet spot SS. In other words, the first thin-walled region 24 does not enter the region A2. Thus, the region A2 is formed with a thickness larger than the thickness t1 of the first thin-walled region 24.

Furthermore, in the front view of the hitting face 21, an area of the first thin-walled region 24 is in a range from 15% to 70% of an area of the toe-upper region A1. Here, the area of the toe-upper region A1 is the area of the region surrounded by the lines L1 and L2 and the head contour in the front view.

Effect of Embodiment

Since the head 1 according to the present embodiment has the first thin-walled region 24 formed in the toe-upper region A1, the weight above the sweet spot SS of the head can be reduced, and thus the lower sweet spot SS can be provided. Hence, the head 1 according to the present embodiment can improve the rebound performance when hitting a ball at a relatively low position of the hitting face 21. In other words, the rebound performance of the major hitting positions of the head such as iron type, fairway wood, and hybrid can be improved, and flight distance of hit balls can be increased. In some preferred embodiments, the sweet spot SS can be located in a range from 19 to 21 mm from the horizontal plane HP by adjusting the area and/or thickness of the first thin-walled region 24.

Figure 9:
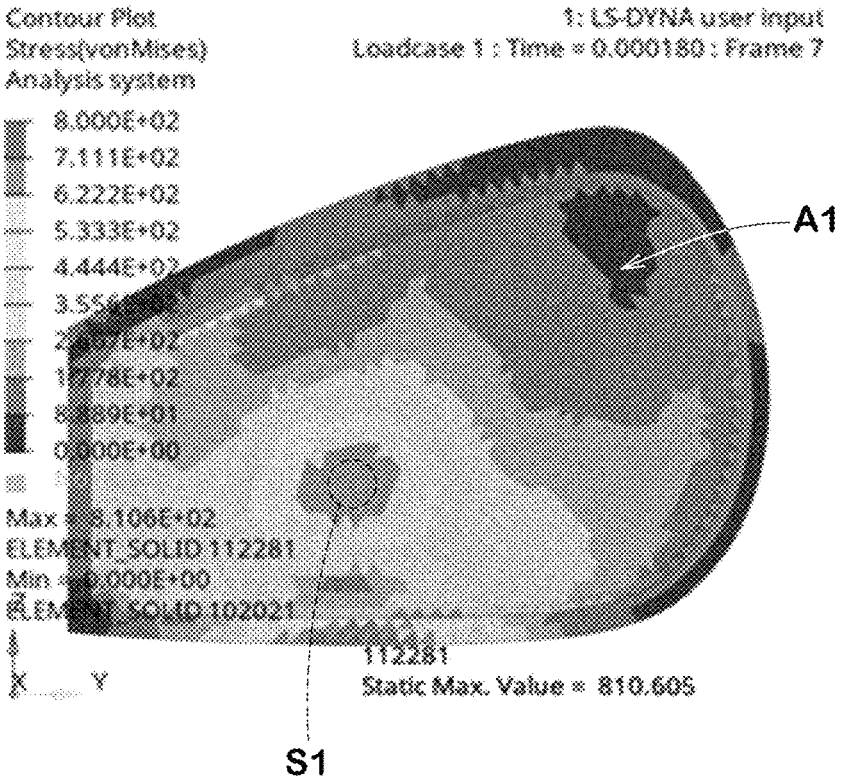
FIG. 9 is a diagram showing a stress distribution of the face portion.

Further, the inventor researched stress distribution of the hitting face 21 when hitting a ball with an iron-type head. The ball striking position was 15 mm upward from the lower peripheral edge of the hitting face and was centered in the toe-heel direction of the hitting face. FIG. 9 shows the result, and the stress is represented by the shade of color. FIG. 9 is a view of the face portion from the back surface side. As is clear from FIG. 9, the largest stress is generated at the striking position S1. On the other hand, it is understood that the above-mentioned toe-upper region A1 has very small stress and hardly deformed.

In the head 1 according to the present embodiment, since the first thin-walled region 24 is formed in the toe upper region A1, so that the toe-upper region A1 is easily flexed. Thus, the head 1 according to the present embodiment can promote the elastically deformation of the toe-upper region A1 which has hardly been flexed so far when hitting a ball. As a result, a flexible area of the hitting face 21 can be expanded and the rebound performance can further be improved. Furthermore, by providing the first thin-walled region 24, the hitting face 21 becomes easier to bend when hitting a ball above the sweet spot SS. Thus, the rebound performance in the upper hitting can also be improved, resulting in expanding the high rebound area of the hitting face.

Since there is a possibility of actually hitting the vicinity of the sweet spot SS, the first thin-walled region 24 is formed outside the region A2 having a radius of 5 mm centered on the sweet spot SS. As a result, the above effects can be exerted without impairing the durability of the face portion 2. In order to further reliably suppress the deterioration of the durability of the face portion 2, the first thin-walled region 24 is preferably located outside a region A3 having a radius of 10 mm centered on the sweet spot SS, more preferably, outside a region A4 having a radius of 15 mm.

Further, since the area of the first thin-walled region 24 is in a range from 15% to 70% of the area of the toe-upper region A1, the toe-upper region A1 can help to improve both durability and large flexure when hitting a ball. That is, when the area of the first thin-walled region 24 is less than 15% of the area of the toe-upper region A1, the toe-upper region A1 may not elastically deform sufficiently when hitting a ball. Thus, it may be difficult to obtain a lower sweet spot SS as well as the increase effect of high rebound area. Conversely, when the area of the first thin-walled region 24 exceeds 70% of the area of the toe-upper region A1, the durability of the face portion 2 may deteriorate. In order to achieve both of these performances at a higher level, the area of the first thin-walled region 24 is preferably equal to or more than 20% of the area of the toe-upper region A1, more preferably equal to or more than 25%, but preferably equal to or less than 60% of the area of the toe-upper region A1, more preferably equal to or less than 50%.

[Thickness of Face Portion]

In the present embodiment, although the thickness t1 of the first thin-walled region 24 is not limited, in order not to impair durability, it may be equal to or more than 0.5 mm, preferably equal to or more than 1.0 mm, more preferably equal to or more than 1.2 mm. Further, the thickness t1 of the first thin-walled region 24 is, for example, equal to or less than 2.0 mm, preferably equal to or less than 1.8 mm, still further preferably equal to or less than 1.6 mm, in order to further enhance the effect of making the toe-upper region A1 more flexible while lowering the sweet spot SS.

A thickness t2 (in this embodiment, the maximum thickness t2 of the face plate 100, and the same applies hereinafter), which is the standard of the face portion 2, is not particularly limited. In order to more reliably suppress the deterioration of durability, it is preferable that the thickness t2 is larger than t1, for example, preferably equal to or more than 1.0 mm, more preferably equal to or more than 1.5 mm, still further preferably equal to or more than 1.8 mm.

Further, in order to make it more flexible, the thickness t2 of the face portion 2 may be, for example, equal to or less than 3.0 mm, preferably equal to or less than 2.5 mm, more preferably equal to or less than 2.2 mm.

[Embodiment of First Thin-Walled Region]

As illustrated in FIG. 8, the first thin-walled region 24 may be provided so as to extend widely on an outer peripheral side of the hitting face 21 in order to make the toe-upper region A1 more effectively flexible. For example, in the front view shown in FIG. 8, a portion of the first thin-walled region 24 may be formed to overlap the support surface 202 of the head main body 200.

Figure 10:
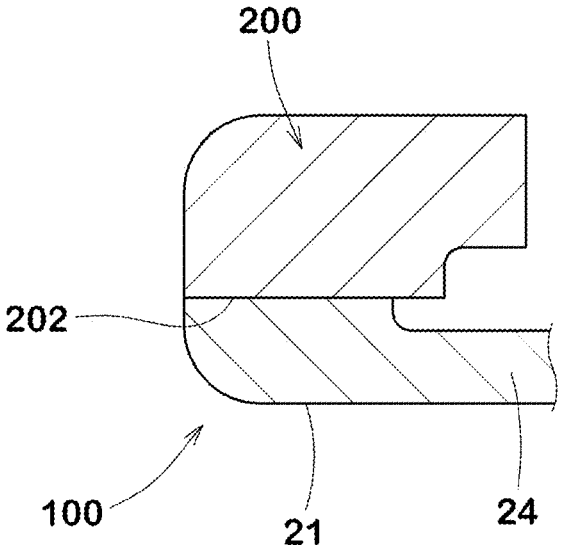
FIG. 10 is a cross-sectional view taken along the line X-X of FIG. 8.

FIG. 10 illustrates a cross-sectional view taken along the lines X-X of FIG. 8. As illustrated in FIG. 10, the first thin-walled region 24 that overlaps the support surface 202 is preferably separated from the support surface 202 in the head front-back direction. In such an embodiment, the first thin-walled region 24, which tends to be flexure when hitting a ball, can be extended to the outer peripheral side of the hitting face 21 without being restricted by the support surface 202. Thus, this embodiment can make the hitting face 21 more flexible.

Second Embodiment

Figure 11:
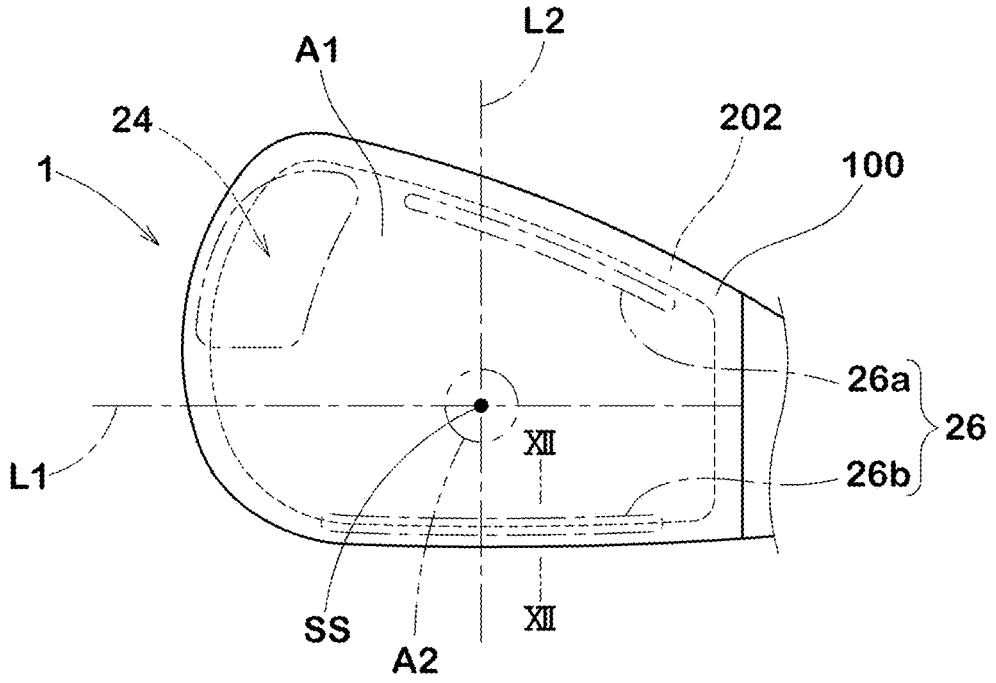
FIG. 11 is a front view of the hitting face in accordance with the second embodiment.

FIG. 11 illustrate a front view of the hitting face 21 in accordance with the second embodiment. As illustrated in FIG. 11, in the head 1 according to this embodiment, at least one groove 26 extending in the toe-heel direction is provided on an upper and/or lower side of the back surface 102 of the face plate 100 which constitutes the back face 22.

In the present embodiment, the at least one groove 26 includes a groove 26*a* on an upper side and a groove 26*b* on the sole side, but only one of them may be used.

The groove 26*a* on the upper side extends above the sweet spot SS in the toe-heel direction. The groove 26*b* on the sole side extends below the sweet spot SS in the toe-heel direction. Both grooves 26*a* and 26*b* extend along the contour of the hitting face 21 across the vertical line L2. In addition, the groove 26*a* on the upper side and the groove 26*b* on the sole side have respective closed ends on the toe side, and are configured to be separated from the first thin-walled region 24.

Figure 12:
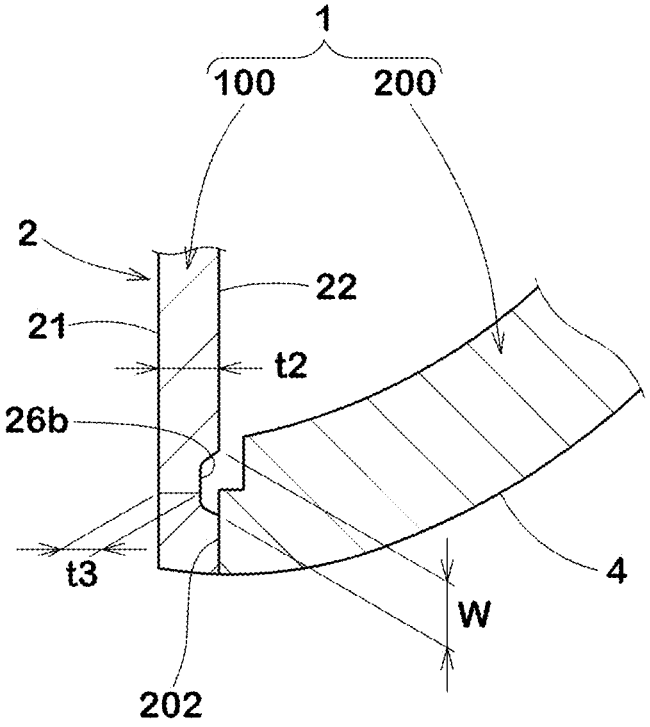
FIG. 12 is a cross-sectional view taken along the line XII-XII of FIG. 11.

FIG. 12 illustrates a cross-sectional view taken along the lines XII-XII of FIG. 11. As illustrated in FIG. 12, in the face portion 2, the portions where the grooves 26*a* and 26*b* are provided are thinned with respective thicknesses t3. These thicknesses t3 are smaller than the standard thickness t2 of the face portion 2. Thus, in the head 1 according to this embodiment, a high rebound area can further be expanded because the upper and/or lower portion of the hitting face 21 is more likely to be flexure when hitting a ball.

In some preferred embodiments, as illustrated in FIG. 11, the groove 26*a* and/or 26*b* may be provided so as to be located on an outer peripheral side of the hitting face 21 in order to flex the face portion 2 more. In the front view of the head shown in FIG. 11, a portion of the groove 26*a* or 26*b* (in this embodiment, the groove 26*b* on the sole side) may be formed so as to overlap the support surface 202 of the head main body 200.

On the other hand, as illustrated in FIG. 12, the groove 26*a* or 26*b* overlapping the support surface 202 (in this example, the groove 26*b* on the sole side) is preferably separated from the support surface 202 in the front-back direction of the head. In such an embodiment, the portion of the groove 26 that is easily flexure when hitting a ball can be positioned on the outer peripheral side of the hitting face 21 without being restricted by the support surface 202. As a result, the hitting face 21 can be configured to be more flexible.

A thickness t3 of the portion where the at least one groove 26 is provided is not particularly limited, but it is preferable that the thickness t3 is in a range of 1.50 to 2.0 mm, for example, from the viewpoint of ensuring the durability of the face portion 2. In particular, it is preferable that the thickness t3 of the groove 26 is larger than the thickness t1 of the first thin-walled region 24. That is, the thicknesses of the face portion 2 is preferably t1<t3<t2.

A width w of the at least one groove 26 (shown in FIG. 12) is, for example, equal to or more than 0.5 mm, preferably equal to or more than 1.0 mm, more preferably equal to or more than 1.5 mm. From the viewpoint of ensuring the durability of the face portion 2, the width w of the groove 26, for example, is equal to or less than 3.0 mm, preferably equal to or less than 2.5 mm, more preferably equal to or less than 2.0 mm.

In the second embodiment, if a groove 26 separated from the first thin-walled region 24 exists and a part of the groove 26 extends in the toe-upper region A1, the "area of the first thin-walled region 24" is defined as the total area of the first thin-walled region 24 and the groove 26 within the toe-upper region A1.

Third Embodiment

Figure 13:
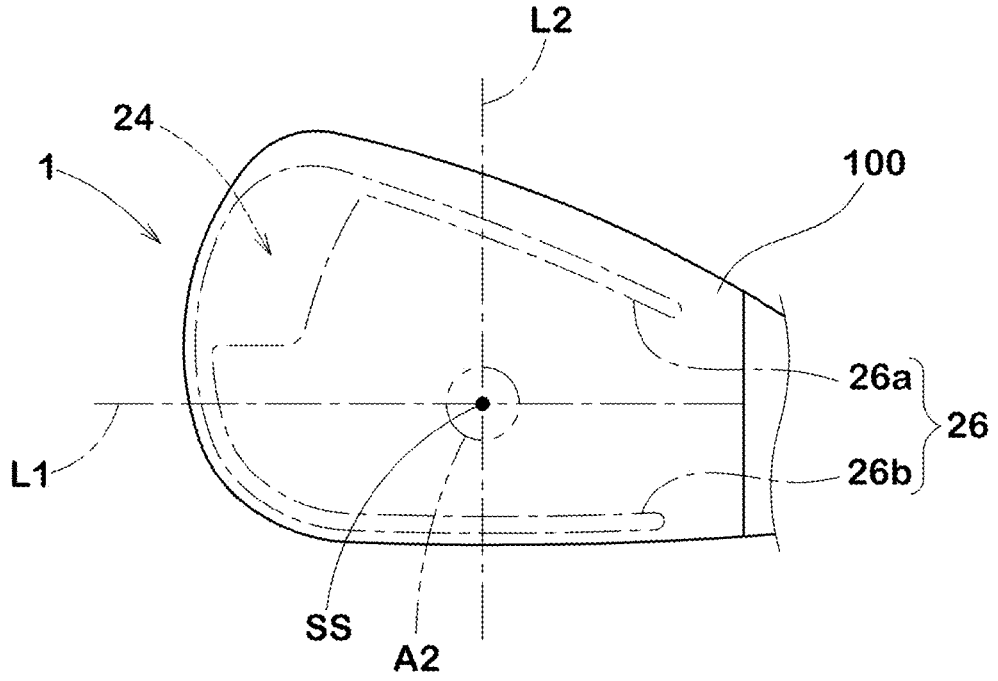
FIG. 13 is a front view of the hitting face in accordance with the third embodiment.

FIG. 13 illustrates a front view of the hitting face 21 in accordance with the third embodiment. As illustrated in FIG. 13, in the head 1 according to the third embodiment, at least one groove 26 extending in the toe-heel direction is formed on the upper and/or lower side of the back surface 102 (shown in FIG. 4) of the face plate 100 which constitutes the back face 22. The third embodiment is different from the second embodiment in that the toe side of the grooves 26*a* on the upper side and the groove 26*b* on the sole side are in communication with the first thin-walled region 24. Such an embodiment is preferable in that the first thin-walled region 24 and the grooves 26 cooperate with each other to form the hitting face 21 more flexible.

In the third embodiment, if there is a groove 26 that communicates with the first thin-walled region 24 and a part of the groove 26 extends within the toe-upper region A1, the "area of the first thin-walled region 24" is defined as the total area of the first thin-walled region 24 and groove 26 within the toe-upper region A1.

While the particularly preferable embodiments in accordance with the present disclosure have been described in detail, the present disclosure is not limited to the illustrated embodiments, but can be modified and carried out in various aspects within the scope of the disclosure.

Working Example

In order to confirm the effect of the present disclosure, more detailed examples of the present disclosure will be described. However, the present disclosure is not limited to these examples.

Iron-type golf club heads (Examples) having the basic structures shown in FIGS. 1 to 4 were prepared based on the specifications in Table 1 and their performance was tested. For comparison, a golf club head (comparative example) other than the present disclosure was also tested in the same manner. Comparative example 1 is equipped with the face plate having a constant thickness (thickness t2). The common specifications of the heads are as follows.

Iron club head number: #6

Head weight: 260 g

Thickness t1 of the first thin-walled region: 1.55 mm

Standard thickness t2 of the face plate: 2.10 mm

Thickness t3 of portions where groove(s) is provided: 1.65 mm

Groove width w: 2 mm

As the rebound performance, the COR of each head was calculated by computer simulation. The COR stands for Coefficient of Restitution and was calculated based on "Interim Procedure for Measuring the Coefficient of Restitution of an Iron Clubhead Relative to a Baseline Plate Revision 1.3, Jan. 1, 2006" defined by USGA (United States Golf Association). It can be evaluated that the larger the COR value, the better the rebound of the face at the measurement position. The COR value was calculated at two positions: the sweet spot position (SS position) and the position 15 mm upward from the lower peripheral edge of the hitting face and the intermediate position in the toe-heel direction (lower striking position).

Further, a real hitting test was conducted for durability. In this test, a same FRP club shaft was attached to each golf club head to prepare an iron-type golf club (total length 38 inches), then they were attached to a swing robot, then the head speed of the robot was adjusted to 39 m/s, then a golf ball was hit by each golf club, and then the number of hits until the face portion was damaged was measured (up to 10,000 hits). At every 100 hitting, the condition of each club head was checked visually. The test results show that the larger the value, the better the durability. If no damage occurs, "no damage" is indicated.

Table 1 shows the test results.

TABLE 1

| | Ex. 1 | Ex. 2 | Ex. 3 | Ex. 4 | Ex. 5 | Ex. 6 | Ex. 7 | Ref. 1 | Ref. 2 | Ref. 3 |
|---|---|---|---|---|---|---|---|---|---|---|
| Figure showing shape of face portion | FIG. 8 | FIG. 8 | FIG. 8 | FIG. 8 | FIG. 8 | FIG. 11 | FIG. 13 | — | FIG. 8 | FIG. 8 |
| Area of first thin-walled region/area of toe-upper region | 15% | 20% | 30% | 50% | 70% | 30% | 30% | 0% | 5% | 100% |
| Groove(s) extending in toe-heel direction | none | none | none | none | none | applied | applied | none | none | none |
| Presence or absence of first thin-walled region in area A2 | absence | absence | absence | absence | absence | absence | absence | — | absence | presence |
| Presence or absence of first thin-walled region in area A3 | absence | absence | absence | absence | presence | absence | absence | — | absence | presence |
| Presence or absence of first thin-walled region in area A4 | absence | absence | absence | presence | presence | absence | absence | — | absence | presence |
| Sweet spot height (mm) | 20.45 | 20.40 | 20.30 | 20.20 | 20.10 | 20.30 | 20.30 | 20.55 | 20.53 | 20.00 |
| Rebound performance (COR at SS position) | 0.830 | 0.831 | 0.835 | 0.838 | 0.841 | 0.840 | 0.840 | 0.830 | 0.830 | 0.845 |
| Rebound performance (COR at lower striking position) | 0.763 | 0.765 | 0.773 | 0.785 | 0.790 | 0.790 | 0.790 | 0.760 | 0.761 | 0.795 |
| Durability (number of hitting until damaged) | no damage | no damage | no damage | 8000 | 5000 | no damage | no damage | no damage | no damage | 2000 |

As a result of the test, it was confirmed that the heads of the example had a lower sweet spot and an improved COR at the lower striking position without impairing the durability.

The following notes are disclosed regarding the above-described embodiments.

[Note 1]

A golf club head comprising:

a face portion comprising a hitting face for striking a ball, a sweet spot on the hitting face, a toe, a back face opposite the hitting face, and a first thin-walled region formed by being recessed the back face, wherein in a front view of the face portion viewed from a direction orthogonal to the hitting face, the first thin-walled region is provided in a toe-upper region that is a region above and on a toe side with respect to the sweet spot, the first thin-walled region is provided outside a region having a radius of 5 mm centered on the sweet spot, and an area of the first thin-walled region is in a range from 15% to 70% of an area of the toe-upper region.

[Note 2]

The golf club head according to Note 1, wherein a thickness of the first thin-walled region is in a range from 0.5 to 2.0 mm.

[Note 3]

The golf club head according to Note 1 or 2, wherein the first thin-walled region is provided outside a region having a radius of 10 mm centered on the sweet spot.

[Note 4]

The golf club head according to any one of Notes 1 to 3, wherein the first thin-walled region has a smallest thickness in the face portion.

[Note 5]

The golf club head according to any one of Notes 1 to 4, wherein the face portion comprises a face plate and a face receiving portion, the face receiving portion having a support surface that supports a peripheral portion of the face plate from a back side of the head, in the front view of the face portion, a portion of the first thin-walled region overlaps the support surface, and the first thin-walled region is separated from the support surface in a head front-back direction.

[Note 6]

The golf club head according to any one of Notes 1 to 5, wherein the back face is provided with a groove extending in a toe-heel direction of the head on upper and/or lower side of the back face.

[Note 7]

The golf club head according to Note 6, wherein a thickness of the face portion provided with the groove is greater than a thickness of the first thin-walled region.

[Note 8]

The golf club head according to Note 6 or 7, wherein the groove is separated from the first thin-walled region.

[Note 9]

The golf club head according to Note 7, wherein a toe side of the groove is connected to the first thin-walled region.

[Note 10]

The golf club head according to any one of Notes 6 to 9, wherein the face portion comprises a face plate and a face receiving portion, the face receiving portion having a support surface that supports a peripheral portion of the face plate from a back side of the head, in the front view of the face portion, a portion of the groove overlaps the support surface, and the groove is separated from the support surface in a head front-back direction.

[Note 11]

The golf club head according to any one of Notes 1 to 10, wherein the golf club head is an iron golf club head.

The invention claimed is:

1. A golf club head comprising:

a face portion comprising a hitting face for striking a ball, a sweet spot on the hitting face, a toe, a back face opposite the hitting face, and a first thin-walled region formed by being recessed the back face, wherein in a front view of the face portion viewed from a direction orthogonal to the hitting face, the first thin-walled region is provided in a toe-upper region that is a region above the sweet spot and on a toe side with respect to the sweet spot, the first thin-walled region is provided outside a region having a radius of 5 mm centered on the sweet spot, and an area of the first thin-walled region is in a range from 15% to 70% of an area of the toe-upper region.

2. The golf club head according to claim 1, wherein a thickness of the first thin-walled region is in a range from 0.5 to 2.0 mm.

3. The golf club head according to claim 1, wherein the first thin-walled region is provided outside a region having a radius of 10 mm centered on the sweet spot.

4. The golf club head according to claim 1, wherein the first thin-walled region has a smallest thickness in the face portion.

5. The golf club head according to claim 1, wherein the face portion comprises a face plate and a face receiving portion, the face receiving portion having a support surface that supports a peripheral portion of the face plate from a back side of the head, in the front view of the face portion, a portion of the first thin-walled region overlaps the support surface at least partially, and the first thin-walled region is separated from the support surface in a head front-back direction.

6. The golf club head according to claim 1, wherein the back face is provided with a groove extending in a toe-heel direction of the head on upper and/or lower side of the back face.

7. The golf club head according to claim 6, wherein a thickness of the face portion provided with the groove is greater than a thickness of the first thin-walled region.

8. The golf club head according to claim 6, wherein the groove is separated from the first thin-walled region.

9. The golf club head according to claim 7, wherein a toe side of the groove is connected to the first thin-walled region.

10. The golf club head according to claim 6, wherein the face portion comprises a face plate and a face receiving portion, the face receiving portion having a support surface that supports a peripheral portion of the face plate from a back side of the head, in the front view of the face portion, a portion of the groove overlaps the support surface at least partially, and the groove is separated from the support surface in a head front-back direction.

11. The golf club head according to claim 1, wherein the golf club head is an iron golf club head.

12. A golf club head comprising:

a face portion comprising a hitting face for striking a ball, a sweet spot on the hitting face, a toe, a back face opposite the hitting face, and a first thin-walled region formed by being recessed the back face, wherein in a front view of the face portion viewed from a direction orthogonal to the hitting face, the first thin-walled region is provided in a toe-upper region that is a region above the sweet spot and on a toe side with respect to the sweet spot, the first thin-walled region is provided outside a region having a radius of 5 mm centered on the sweet spot, and an area of the first thin-walled region is in a range from 15% to 70% of an area of the toe-upper region, wherein the back face is provided with a groove extending in a toe-heel direction of the head on upper and/or lower side of the back face, and the groove is separated from the first thin-walled region.

13. The golf club head according to claim 12, wherein a thickness of the first thin-walled region is in a range from 0.5 to 2.0 mm.

14. The golf club head according to claim 12, wherein the first thin-walled region is provided outside a region having a radius of 10 mm centered on the sweet spot.

15. The golf club head according to claim 12, wherein the first thin-walled region has a smallest thickness in the face portion.

16. The golf club head according to claim 12, wherein the face portion comprises a face plate and a face receiving portion, the face receiving portion having a support surface that supports a peripheral portion of the face plate from a back side of the head, in the front view of the face portion, a portion of the first thin-walled region overlaps the support surface at least partially, and the first thin-walled region is separated from the support surface in a head front-back direction.

17. A golf club head comprising:

a face portion comprising a hitting face for striking a ball, a sweet spot on the hitting face, a toe, a back face opposite the hitting face, and a first thin-walled region formed by being recessed the back face, wherein in a front view of the face portion viewed from a direction orthogonal to the hitting face, the first thin-walled region is provided in a toe-upper region that is a region above the sweet spot and on a toe side with respect to the sweet spot, the first thin-walled region is provided outside a region having a radius of 5 mm centered on the sweet spot, and an area of the first thin-walled region is in a range from 15% to 70% of an area of the toe-upper region, wherein the back face is provided with a groove extending in a toe-heel direction of the head on upper and/or lower side of the back face, and the groove is connected to the first thin-walled region.

18. The golf club head according to claim 17, wherein a thickness of the first thin-walled region is in a range from 0.5 to 2.0 mm.

19. The golf club head according to claim 17, wherein the first thin-walled region is provided outside a region having a radius of 10 mm centered on the sweet spot.

20. The golf club head according to claim 17, wherein the first thin-walled region has a smallest thickness in the face portion.

* * * * *